US006268686B1

(12) United States Patent
Iwasa et al.

(10) Patent No.: US 6,268,686 B1
(45) Date of Patent: Jul. 31, 2001

(54) COLD CATHODE ELEMENT

(75) Inventors: Takashi Iwasa, Wako; Junzo Ishikawa, Kyoto, both of (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/237,844

(22) Filed: Jan. 27, 1999

(30) Foreign Application Priority Data

Jan. 29, 1998 (JP) ..... 10-016854
Jul. 15, 1998 (JP) ..... 10-216418

(51) Int. Cl.[7] ..... H01J 1/02
(52) U.S. Cl. ..... 313/310; 313/311; 313/309; 313/351
(58) Field of Search ..... 313/311, 310, 313/308, 351, 495

(56) References Cited

U.S. PATENT DOCUMENTS 5,650,201 * 7/1997 Tompa ..... 427/523
5,760,536 * 6/1998 Susukida et al. ..... 313/311
5,852,303 * 12/1998 Cuomo et al. ..... 257/9

* cited by examiner

*Primary Examiner*—Vip Patel
*Assistant Examiner*—Ken A. Berck
(74) *Attorney, Agent, or Firm*—Arent Fox Kintner Plotkin & Kahn, PLLC

(57) ABSTRACT

A cold cathode element for emitting an electron on application of an electric field. The element includes a diamond carbon film having a half width Hw of a photoelectron spectrum of a $C_{1S}$ electron using an X-ray photoelectron spectroscopy, of 1.72 eV or more. The cold cathode element has the function of sufficiently emitting electrons even by applying a low voltage, and thus the element has high practical utility.

3 Claims, 9 Drawing Sheets

COLD CATHODE ELEMENT

BACKGROUND OF THE INVENTION

1. Field of the Invention

The present invention relates to a cold cathode element, which emits electrons on application of an electric field.

2. Description of Related Art

A hot cathode element and a cold cathode element have been known as elements for emitting electrons.

A hot cathode element is used in the field represented by a vacuum tube, but has a problem in that it is difficult to be integrated with other components due to the heat generated. On the other hand, a cold cathode element is expected to be used in elements, such as a flat panel display, a voltage amplification element and a high frequency amplification element, since it does not use heat and can be integrated with other components.

SUMMARY OF THE INVENTION

An object of the invention is to provide a highly practical cold cathode element that can sufficiently emit electrons even by application of low voltage.

In order to attain the object, the invention provides a cold cathode element which emits electrons on application of an electric field, the element comprising a diamond carbon film having a half width Hw of a photoelectron spectrum of a $C_{1S}$ electron using X-ray photoelectron spectroscopy of 1.72 eV or more.

The term "diamond carbon film" used herein means a carbon film having characteristics close to a diamond although its crystalline structure is not a diamond single crystal structure.

By setting the half width Hw to the above range for the diamond carbon film, the diamond characteristic, i.e., electric insulating property, of the diamond carbon film is weakened, but the graphite characteristic, i.e., conductivity, is enhanced. Accordingly, the emission electric field of the cold cathode element is lowered to make it possible that electrons are sufficiently emitted even by applying a low voltage.

If the half width Hw is less than 1.72 eV, the diamond characteristic of the diamond carbon film becomes too strong, and the emission electric field is too high.

The invention also provides a cold cathode element for emitting electrons on application of an electric field, the element comprising a diamond carbon film including Cs (cesium) in an amount of from 0.1 to 0.5 atomic %.

The diamond carbon film functions as a cold cathode element by itself. By adding the above-specified amount of Cs to the diamond carbon film, however, turbulence is generated in the structure of the film due to the difference in atomic radius between C (carbon) and Cs, and the electric insulating property of the film is weakened but the conductivity is enhanced. Cs in the film also lowers the work function of C. The emission electric field of the cold cathode element is thus lowered to make it possible that an electron is sufficiently emitted even by applying a low voltage.

If the content of Cs is less than 0.1 atomic %, the effect of the addition of Cs is nil. If the content of Cs is more than 5.0 atomic %, the turbulence in the film becomes large to reduce the $SP^3$ characteristic of the film, and the field emission by the negative electron affinity of the film cannot be expected. In this case, when the amount of Cs becomes more than 1.8 atomic %, the Cs amount at the surface of the film is excessive, and oxidation of Cs rapidly proceeds due to exposure of the film to the air, which results in possible formation of cracks in the film. Therefore, the cold cathode element having a Cs content of more than 1.8 atomic % but not more than 5.0 atomic % must be produced and used in vacuum. In other words, the cold cathode element that is possibly exposed to the air, preferably has a Cs content of 1.8 atomic % or less.

The diamond carbon film may be used singly, or may be used as a material constituting a surface covering layer of a cold cathode element comprising Si, for example, to enhance the performance of the element.

The above and other objects, characteristic features and advantages of the invention will be apparent from the following detailed description with respect to preferred embodiments according to the attached drawings.

DESCRIPTION OF THE PREFERRED EMBODIMENTS

Embodiment I

Figure 1:
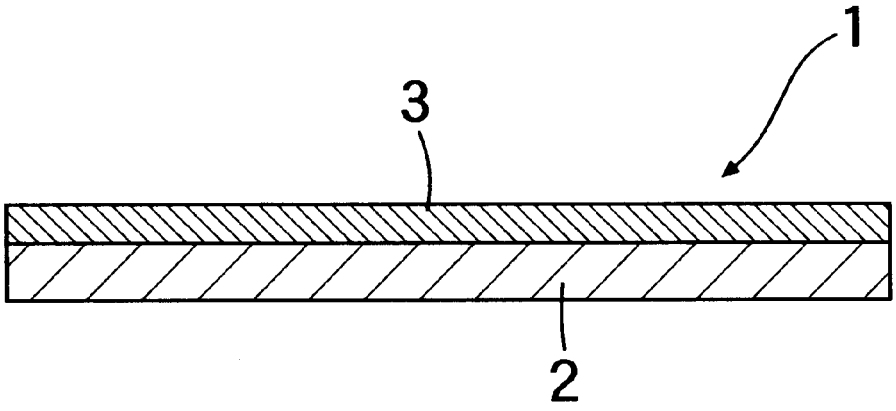
FIG. 1 is a schematic cross-sectional view showing the cathode unit according to an embodiment of the invention.

A cathode unit 1 is shown in FIG. 1, which comprises a cathode plate 2 made of Al and a cold cathode element 3 formed on the surface of the cathode plate 2. The cold cathode element 3 comprises a diamond carbon film having a half width Hw of a photoelectron spectrum of a $C_{1S}$ electron using X-ray photoelectron spectroscopy and the electron spectroscopy for chemical analysis of 1.72 eV or more.

Figure 2:
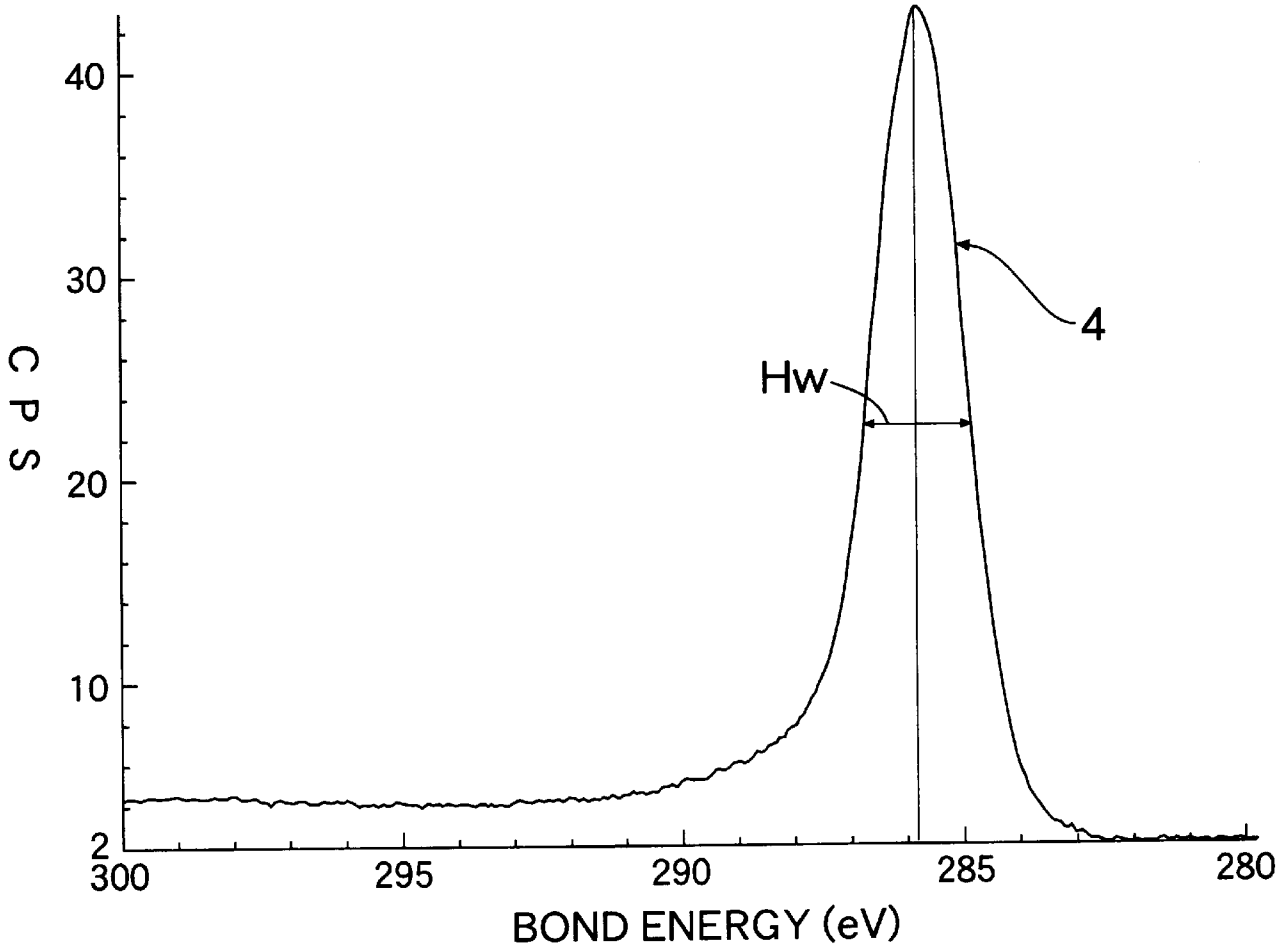
FIG. 2 is a photoelectron spectrum of a $C_{1S}$ electron of the diamond carbon film by the X-ray photoelectron spectroscopy.

The half width Hw can be obtained from the photoelectron spectrum of a $C_{1S}$ electron 4 of the diamond carbon film shown in FIG. 2, which is obtained by subjecting the diamond carbon film to X-ray photoelectron spectroscopy. The half width Hw is determined by the width of the spectrum (eV) at the position of ½ of the peak value.

By setting the half width Hw to the range specified in the invention for the diamond carbon film, the diamond characteristic, i.e., electric insulating property, of the diamond carbon film is weakened, but the graphite characteristic, i.e., conductivity, is enhanced. Accordingly, the emission electric field of the cold cathode element 3 is lowered to make it possible that electrons are sufficiently emitted by applying a low voltage.

The diamond carbon film is formed by the sputtering method or the ion beam vapor deposition method. In the ion beam vapor deposition method, a positive ion beam or a negative ion beam is employed. In this case, progressively higher atomic densities of the diamond carbon film are provided by the sputtering method, the positive ion beam vapor deposition method, and the negative ion beam vapor deposition method in that order. That is, the conductivity becomes progressively higher in that order, and the emission electric field becomes progressively lower in that order, with the same half width Hw.

The reason for the above phenomenon is described below. In the sputtering method, the energy for vapor deposition is unsettled and the size of the vapor deposition particle is random. Therefore, a number of defects are formed in the diamond carbon film, which inhibit the conductivity of the film. In the positive or negative ion beam vapor deposition method, on the other hand, the energy for vapor deposition can be controlled to make the diamond carbon film dense by effectively preventing the formation of defects in the film. Such an effect is remarkable in the diamond carbon film obtained by the negative ion beam vapor deposition method. This is because the internal potential energy (electron affinity) of the negative ion is lower than that (ionization voltage) of the positive ion.

The embodiment is specifically described below.

Figure 3:
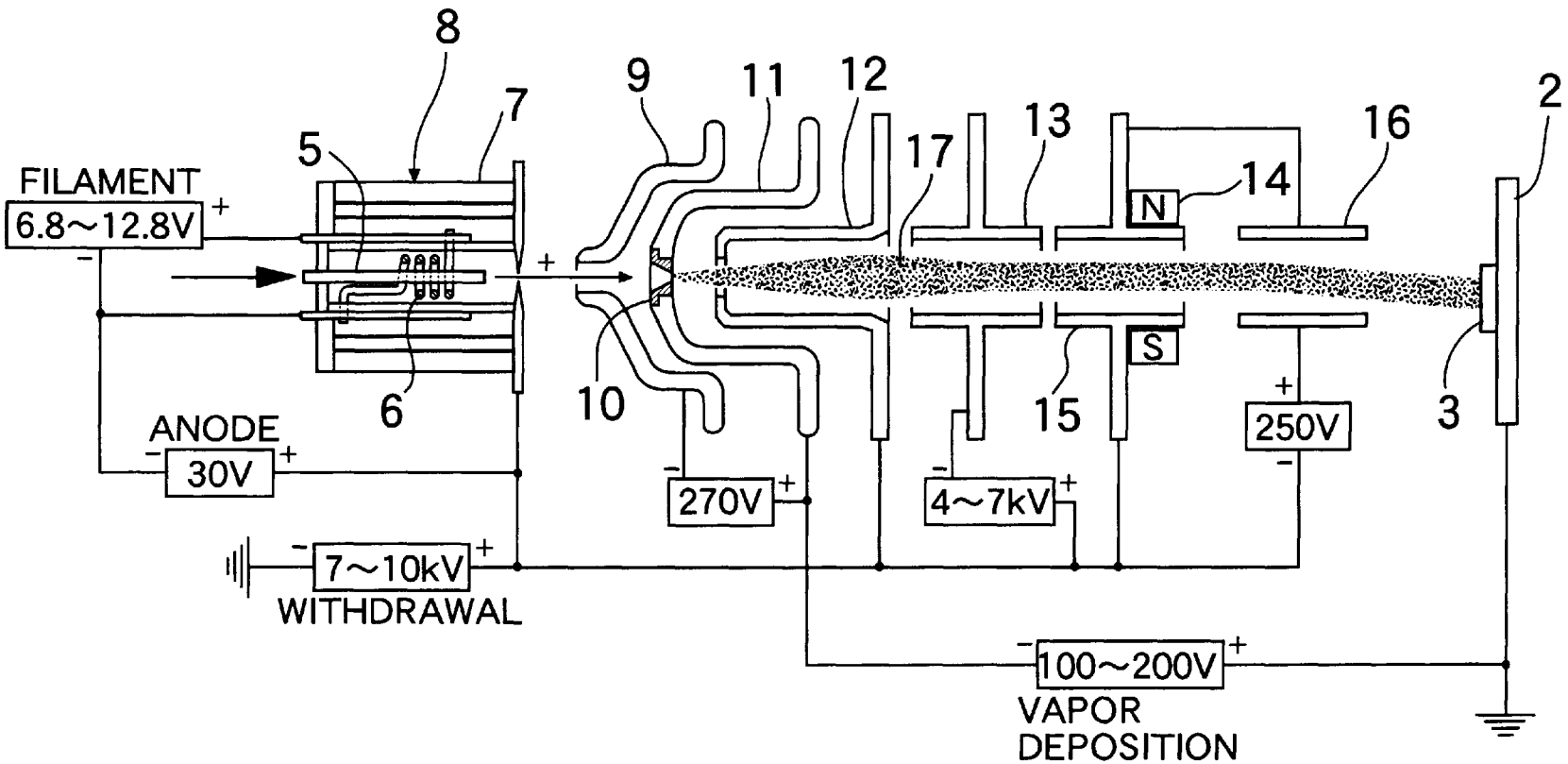
FIG. 3 is a schematic diagram of a ultra-high vacuum negative ion beam vapor deposition apparatus.

(I) Formation of Diamond Carbon Film by Negative Ion Beam Vapor Deposition Method FIG. 3 shows a known ultra-high vacuum negative ion beam vapor deposition apparatus (NIABNIS: neutral and ionized alkaline metal bombardment type heavy negative ion source). The apparatus comprises: a Cs plasma ion source 8 comprising a center anode pipe 5, a filament 6 and a heat shield 7; a suppressor 9; a target electrode 11 having a target 10 comprising high-purity high-density carbon; an electron remover 15 comprising a negative ion withdrawing electrode 12, a lens 13 and a magnet 14; and deflector plates 16.

Upon forming the diamond carbon film 3 (the same symbol as the cold cathode element is used for convenience), the following procedures are carried out: (a) The prescribed voltages are applied to the various parts as shown in FIG. 3. (b) A positive ion of Cs is generated by the Cs plasma ion source 8. (c) A negative ion of C, etc. is generated by sputtering the target 10 with the positive ion of Cs. (d) The negative ion is withdrawn by the negative ion withdrawing electrode 12 through the suppressor 9 to generate a negative ion beam 17. (e) The negative ion beam 17 is converged by the lens 13. (f) An electron contained in the negative ion beam 17 is removed by the electron remover 15. (g) Only the negative ions are sent flying toward an electrode plate 2 by the deflector plates 16.

Figure 4:
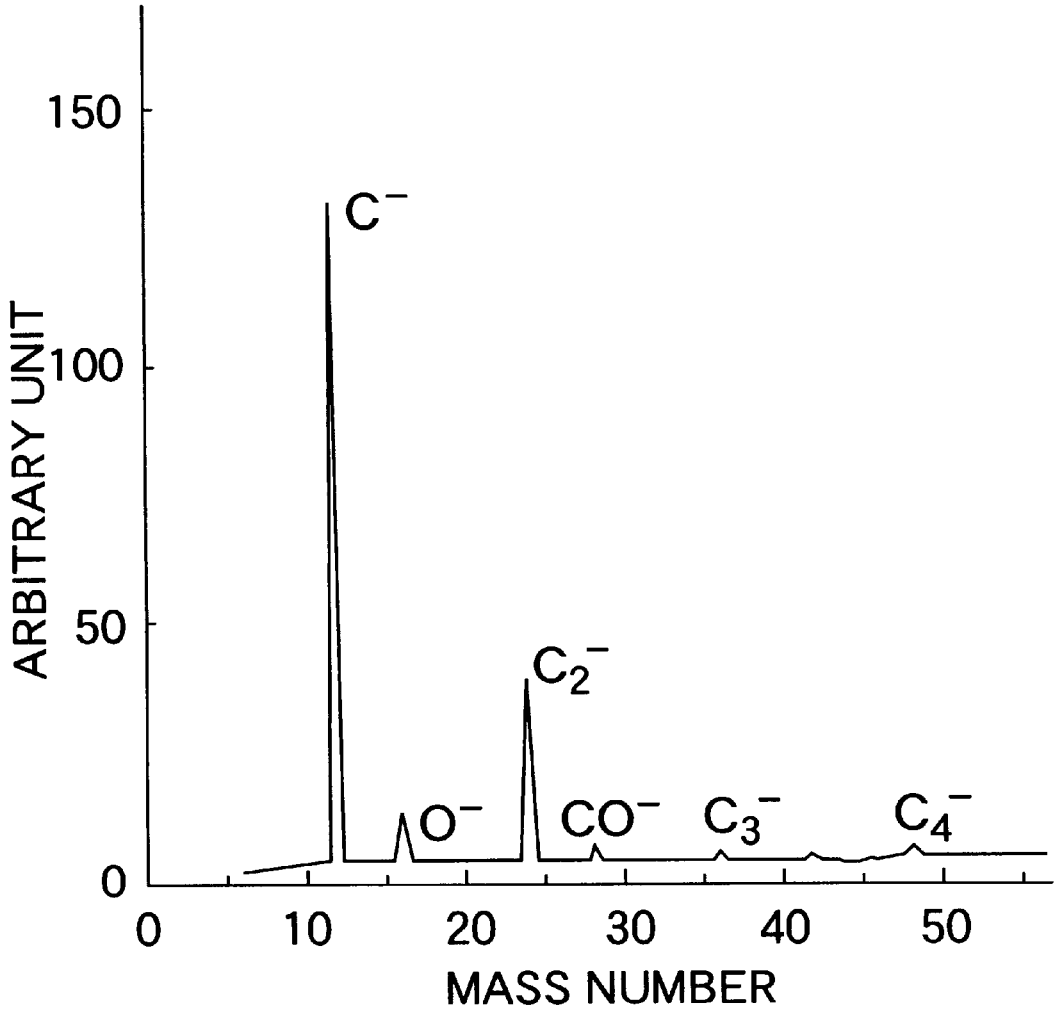
FIG. 4 is a beam spectrum produced by the negative ion beam of the apparatus.

FIG. 4 is a mass spectrum of the negative ion beam 17. The main negative ion of the negative ion beam 17 is a $C^-$ ion having one atom and a C ion having two atoms. The ion current of $C^-$ is larger than that of C.

The formation conditions for Examples 1 to 7 of the diamond carbon films produced by the negative ion beam vapor deposition method are shown in Table 1. The thickness in Examples 1 to 7 was from 0.4 to 0.8 $\mu$m.

TABLE 1

| Diamond carbon film | Vapor deposition voltage (V) | Withdrawing voltage (kV) | Voltage and current of filament (V-A) |
|---|---|---|---|
| Example 1 | 100 | 10 | 12.8–22.0 |
| Example 2 | 200 | 10 | 6.8–16.0 |

TABLE 1-continued

| Diamond carbon film | Vapor deposition voltage (V) | Withdrawing voltage (kV) | Voltage and current of filament (V-A) |
|---|---|---|---|
| Example 3 | 200 | 8 | 9.5–18.0 |
| Example 4 | 200 | 10 | 10.1–19.8 |
| Example 5 | 200 | 8 | 9.5–18.0 |
| Example 6 | 200 | 8 | 12.2–20.0 |
| Example 7 | 200 | 7 | 8.6–17.6 |

The X-ray photoelectron spectroscopy was then conducted for Examples 1 to 7, and the half width Hw was obtained from the resulting photoelectron spectrum of $C_{1S}$ electron 4.

Figure 5:
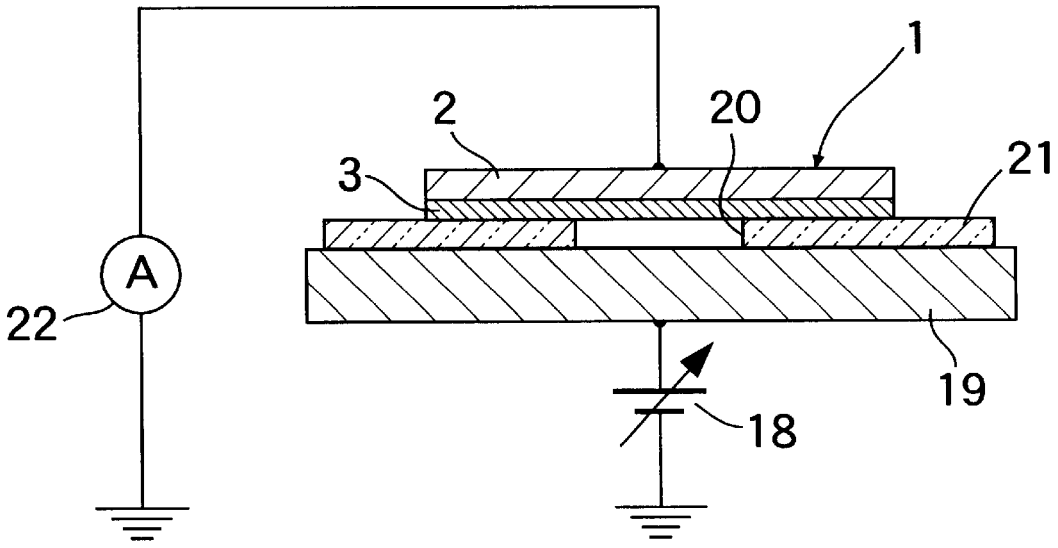
FIG. 5 is a diagram for explaining the measurement of the emission electric field.

The measurement of the emission electric field was conducted for Examples 1 to 7 by the method shown in FIG. 5. A conductive plate 19 made of Al was connected to a power source 18, the voltage of which could be controlled, and a cover glass 21 having a thickness of 150 $\mu$m, in which an opening 20 having a dimension of 0.8 cm in length and 0.8 cm in width (0.64 $cm^2$) is formed in its center, was placed on the conductive plate 19. A diamond carbon film 3 of a cathode unit 1 was placed on the cover glass 21, and an ammeter 22 was connected to a cathode plate 2 of the cathode unit 1. The prescribed voltage was applied to the conductive plate 19 from the power source 18, and the current was read by the ammeter 22. The emission current density ($\mu A/cm^2$) was obtained from the measured current and the area of the opening 20. Taking the practical utility into consideration, when the emission current density reached 8 $\mu A/cm^2$, the emission electric field ($V/\mu m$) was obtained from the corresponding voltage and the thickness of the cover glass 21.

The half width Hw and the emission electric field for Examples 1 to 7 are shown in Table 2.

TABLE 2

| Diamond carbon film | Half width Hw (eV) | Emission electric field ($V/\mu m$) |
|---|---|---|
| Example 1 | 1.68 | 9.2 |
| Example 2 | 1.72 | 3.6 |
| Example 3 | 1.76 | 3.5 |
| Example 4 | 1.77 | 3.2 |
| Example 5 | 1.82 | 3.1 |
| Example 6 | 1.83 | 2.0 |
| Example 7 | 1.87 | 1.4 |

(II) Formation of Diamond Carbon Film by Positive Ion Beam Vapor Deposition Method A diamond carbon film 3 was produced by using the apparatus shown in FIG. 3, and the sputtering was conducted with a positive ion of argon to generate a positive ion of carbon, and the polarities of the negative ion withdrawing electrode 12, the lens 13, the deflector plates 16 and the cathode plate 2 were the reverse of the case of (1) (see FIG. 3).

The formation conditions for Examples 1 to 5 of the diamond carbon films 3 produced by the positive ion beam vapor deposition method are shown in Table 3. The thickness in Examples 1 to 5 was from 0.4 to 0.8 $\mu$m.

TABLE 3

| Diamond carbon film | Vapor deposition voltage (V) | Withdrawing voltage (kV) | Voltage and current of filament (V-A) |
|---|---|---|---|
| Example 1 | 100 | 10 | 12.3–21.0 |
| Example 2 | 200 | 9 | 12.0–20.5 |
| Example 3 | 200 | 9 | 9.8–19.5 |
| Example 4 | 200 | 8 | 11.0–19.8 |
| Example 5 | 200 | 7 | 8.5–17.0 |

The half width Hw was obtained for Examples 1 to 5 in the same manner as described above, and the measurement of the emission electric field was conducted in the same manner as described above.

The half width Hw and the emission electric field for Examples 1 to 5 are shown in Table 4.

TABLE 4

| Diamond carbon film | Half width Hw (eV) | Emission electric field (V/$\mu$m) |
|---|---|---|
| Example 1 | 1.70 | 9.7 |
| Example 2 | 1.72 | 6.5 |
| Example 3 | 1.75 | 5.3 |
| Example 4 | 1.79 | 4.2 |
| Example 5 | 1.89 | 3.9 |

(III) Formation of Diamond Carbon Film by Sputtering Method

A diamond carbon film 3 was produced by using a known high frequency sputtering apparatus.

The formation conditions for Examples 1 to 3 of the diamond carbon films produced by the sputtering method are shown in Table 5. The thickness in Examples 1 to 3 was from 0.4 to 0.8 $\mu$m.

TABLE 5

| Diamond carbon film | Sputtering ion species | Atmospheric pressure (Torr) | High frequency electric power (W) |
|---|---|---|---|
| Example 1 | Ar | $10^{-6}$ | 300 |
| Example 2 | Ar | $10^{-6}$ | 400 |
| Example 3 | Kr | $10^{-6}$ | 300 |

The half width Hw was obtained for Examples 1 to 3 in the same manner as described above, and the measurement of the emission electric field was conducted in the same manner as described above.

The half width Hw and the emission electric field for Examples 1 to 3 are shown in Table 6.

TABLE 6

| Diamond carbon film | Half width Hw (eV) | Emission electric field (V/$\mu$m) |
|---|---|---|
| Example 1 | 1.73 | 8.7 |
| Example 2 | 1.78 | 7.2 |
| Example 3 | 1.89 | 5.9 |

(IV) Electric Field Emission Characteristics

Figure 6:
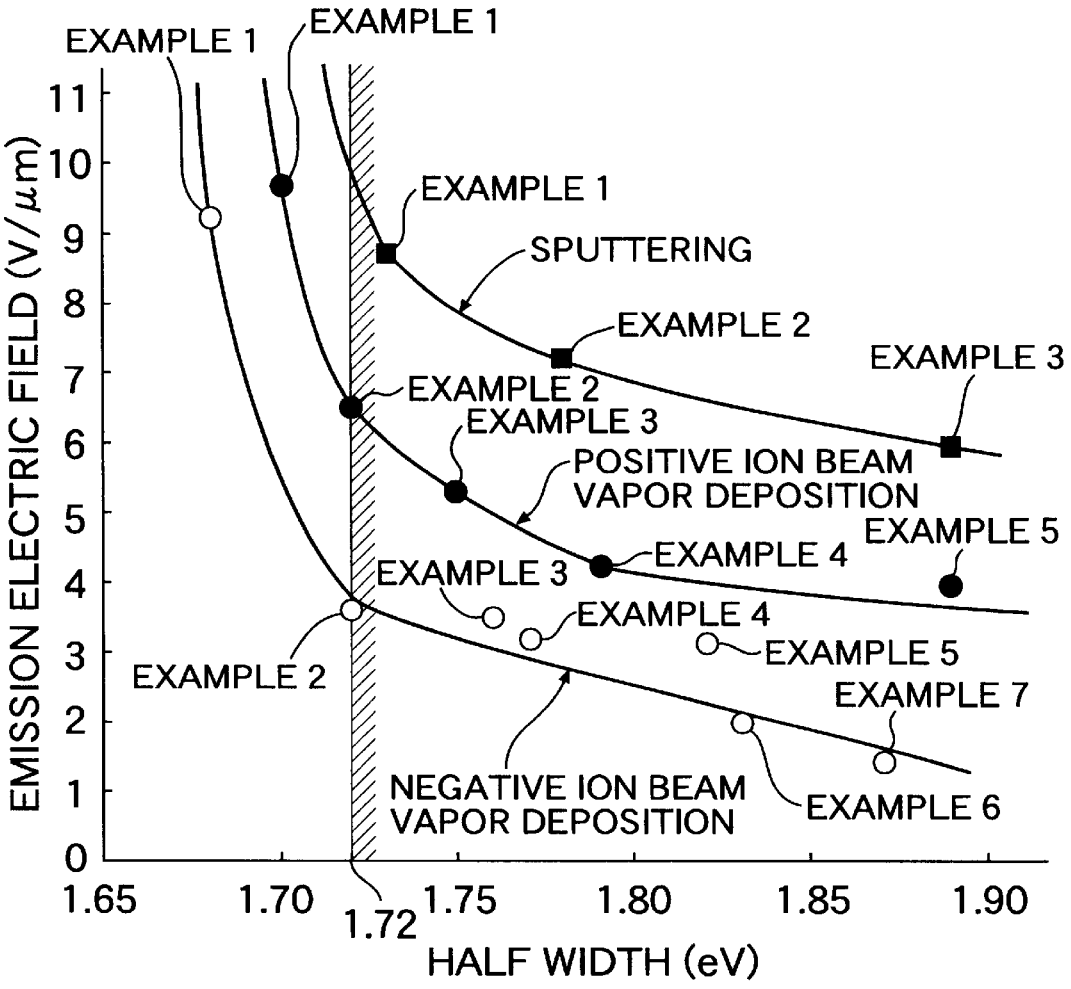
FIG. 6 is a graph showing the relationship between the half width and the emission electric field.

The relationship between the half width Hw and the emission electric field based on Tables 2, 4 and 6 for the diamond carbon films 3 is shown in FIG. 6. It can be understood from FIG. 6 that the emission electric field of the diamond carbon film 3 can be largely lowered by setting the half width Hw at 1.72 eV or more. It is also understood in this case that progressively higher field emission characteristics of the diamond carbon film 3 are provided by the sputtering method, the positive ion beam vapor deposition method, and the negative ion beam vapor deposition method in that order.

Embodiment II

A cathode unit 1 in Embodiment II, like that shown in FIG. 1, comprises a cathode plate 2 made of Al and a cold cathode element 3 formed on the surface of the cathode plate 2. The cold cathode element 3 comprises a diamond carbon film including Cs in an amount of from 0.1 to 5.0 atomic %, 1.8 atomic % or less in this embodiment.

The diamond carbon film functions as a cold cathode element by itself. By adding the above-specified amount of Cs to the diamond carbon film, turbulence is generated in the structure of the film due to the difference in atomic radius between C (0.77 Å) and Cs (2.62 Å), and the electric insulating property of the film is weakened but the conductivity is enhanced. Cs in the film also lowers the work function of C. The emission electric field of the cold cathode element 3 is thus lowered to make it possible that electrons are sufficiently emitted by applying a low voltage.

Cs is not only contained in the interior of the diamond carbon film, but also distributed on the surface of the diamond carbon film in the form of a number of dots. In this case, Cs reacts with oxygen contained in the air owing to its activity to form a stable oxide, and as a result, the Cs oxide forms a number of insulating dots on the surface of the film. Upon application of an electric field on such a surface of the film, the electric field is concentrated on the part other than the insulating dots, and therefore the field emission characteristics of the cold cathode element 3 is enhanced.

The diamond carbon film is formed by the ion beam vapor deposition method. By using a Cs ion as the incident ion in the formation of the film, Cs is uniformly contained in the diamond carbon film. In the ion beam vapor deposition method, a positive ion beam or a negative ion beam is employed. In this case, progressively higher atomic densities of the diamond carbon film are provided by the positive ion beam vapor deposition method and the negative ion beam vapor deposition method in that order. That is, the conductivity of the film becomes progressively higher in that order, and the emission electric field becomes progressively lower in that order. The reason for the difference in atomic density resides in that the internal potential energy (electron affinity) of the negative ion is lower than that (ionization voltage) of the positive ion.

The embodiment is specifically described below.

(I) Formation of Diamond Carbon Film by Negative Ion Beam Vapor Deposition Method Upon forming the diamond carbon film 3 (the same symbol as the cold cathode element is used for convenience), the following procedures are carried out by using the ultra-high vacuum negative ion beam vapor deposition apparatus: (a) The prescribed voltages are applied to the various parts as shown in FIG. 3. (b) A positive ion of Cs is generated by the Cs plasma ion source 8. (c) A negative ion of C, etc. is generated by sputtering the target 10 with the positive ion of Cs. (d) The negative ion is withdrawn by the negative ion withdrawing electrode 12 through the suppressor 9 to generate a negative ion beam 17. (e) The negative ion beam 17 is converged by the lens 13. (f) An electron contained in the negative ion beam 17 is removed by the electron remover 15. (g) Only the negative ions are sent flying toward an electrode plate 2 by the deflector plates 16. The mass spectrum of this negative ion beam 17 is the same as that in FIG. 4.

The formation conditions for Examples 1 to 8 of the diamond carbon films produced by the negative ion beam vapor deposition method are shown in Table 7. The thickness in Examples 1 to 8 was from 0.4 to 0.8 μm.

TABLE 7

| Diamond carbon film | Vapor deposition voltage (V) | Withdrawing voltage (kV) | Voltage and current of filament (V-A) |
|---|---|---|---|
| Example 1 | 200 | 10 | 12.8–22.0 |
| Example 2 | 200 | 10 | 6.8–16.0 |
| Example 3 | 200 | 9 | 9.5–18.0 |
| Example 4 | 200 | 7 | 8.6–17.6 |
| Example 5 | 200 | 7 | 8.75–19.8 |
| Example 6 | 200 | 7 | 8.7–19.5 |
| Example 7 | 200 | 7 | 7.8–16.8 |
| Example 8 | 200 | 10 | 13.2–22.4 |

Figure 7:
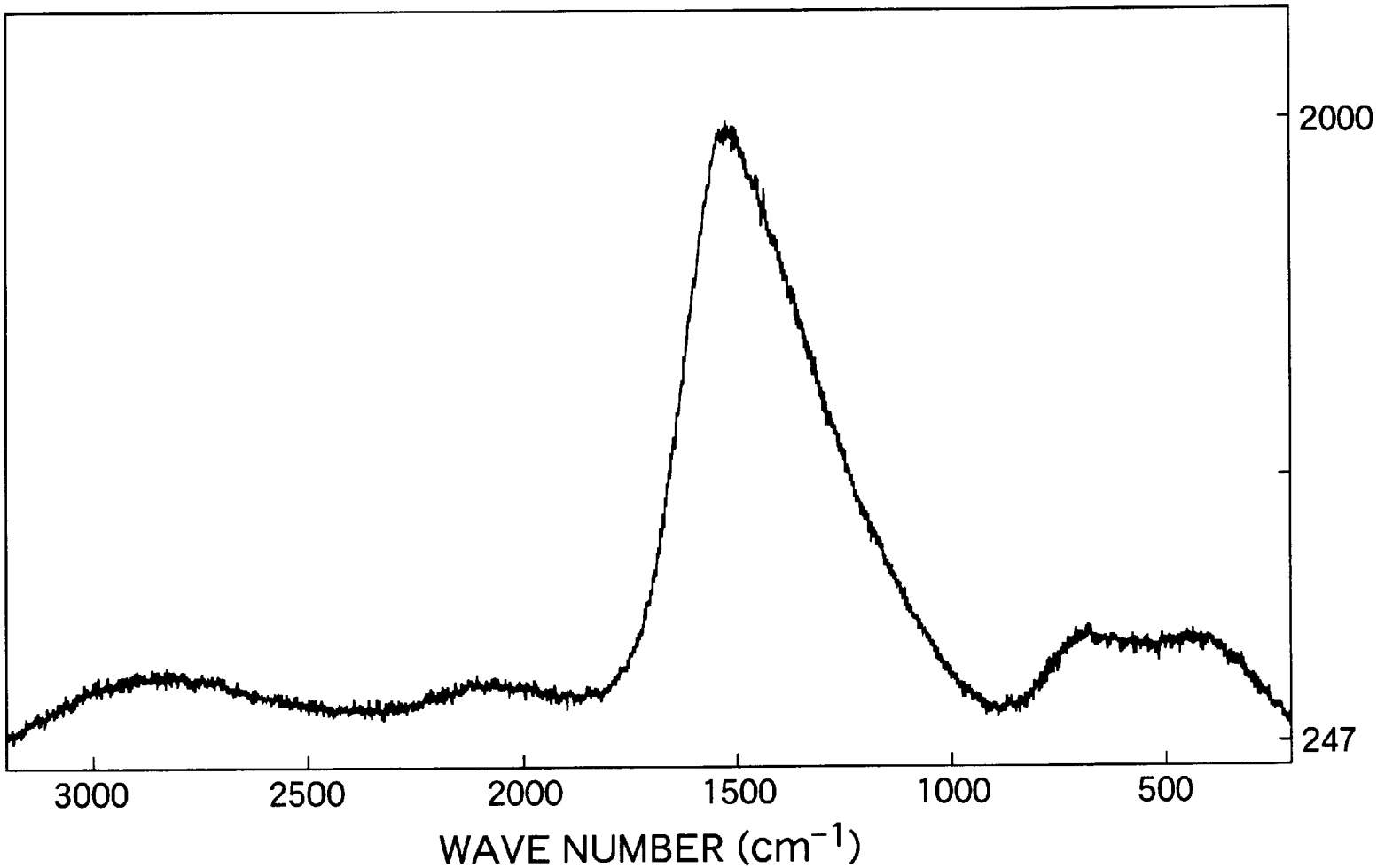
FIG. 7 is a chart showing the analytical result of the diamond carbon film using Raman spectroscopy.

The center parts in Examples 1 to 8 were subjected to Raman spectroscopic analysis to determine whether or not they are amorphous. FIG. 7 shows the analytical result for Example 4, in which a broad Raman band having a center near a wave number of 1,500 $cm^{-1}$ is observed. It is understood from the result of FIG. 7 that Example 4 is amorphous. The similar results to that in FIG. 7 were obtained for the other Examples 1 to 3 and 5 to 8.

Examples 1 to 8 were measured for Cs content by quantitative analysis of the X-ray photoelectron spectroscopy.

Figure 8:
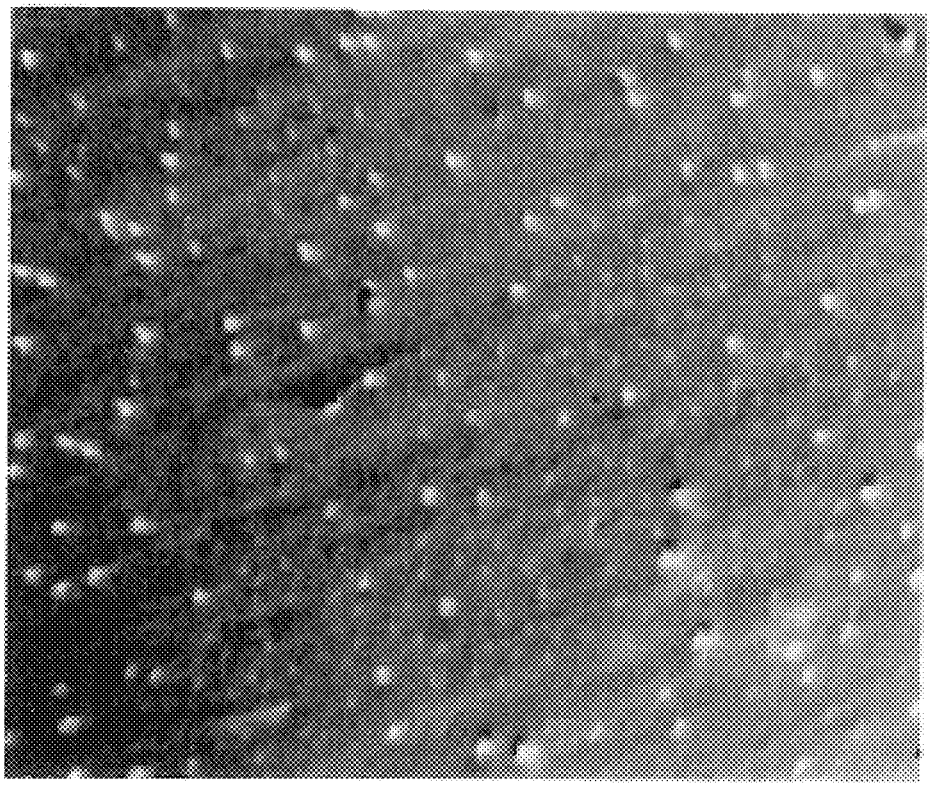
FIG. 8 is a photograph showing the secondary electron image on the surface of the diamond carbon film.

Furthermore, the secondary electron image of the surface of Example 4 was picked up by Auger electron spectroscopy (AES). The photograph obtained is shown in FIG. 8. In FIG. 8, a number of white dots indicate the Cs oxide dispersed on the surface of the diamond carbon film 3. The similar results were obtained for the other Examples 1 to 3 and 5 to 8.

The measurement of the emission electric field (V/μm) was conducted for Examples 1 to 8 in the same manner shown in FIG. 6. The Cs content and the emission electric field for Examples 1 to 8 are shown in Table 8.

TABLE 8

| Diamond carbon film | Cs content (atomic %) | Emission electric field (V/μm) |
|---|---|---|
| Example 1 | 0.1 | 4.9 |
| Example 2 | 0.66 | 3.6 |
| Example 3 | 0.78 | 3.2 |
| Example 4 | 0.98 | 1.4 |
| Example 5 | 1.38 | 2.3 |
| Example 6 | 1.62 | 2.6 |
| Example 7 | 1.87 | 3.5 |
| Example 8 | 0 | 9.25 |

(II) Formation of Diamond Carbon Film by Positive Ion Beam Vapor Deposition Method A diamond carbon film 3 was produced by using the apparatus shown in FIG. 3, and the sputtering was conducted with a positive ion of Cs to generate a positive ion of carbon, and the polarities of the negative ion withdrawing electrode 12, the lens 13, the deflector plates 16 and the cathode plate 2 were the reverse of the case of (1) (see FIG. 3).

The formation conditions for Examples 1 to 4 of the diamond carbon films 3 produced by the positive ion beam vapor deposition method are shown in Table 9. The thickness in Examples 1 to 4 was from 0.4 to 0.8 μm.

TABLE 9

| Diamond carbon film | Vapor deposition voltage (V) | Withdrawing voltage (kV) | Voltage and current of filament (V–A) |
|---|---|---|---|
| Example 1 | 200 | 10 | 12.3–21.0 |
| Example 2 | 200 | 10 | 9.8–18.0 |
| Example 3 | 200 | 7 | 8.5–17.2 |
| Example 4 | 200 | 7 | 7.8–16.8 |

The same Raman spectroscopic analysis was conducted for Examples 1 to 4 to find their amorphous nature. The Cs content was measured in the same manner as above, and the emission electric field was also measured in the same manner as above.

The Cs content and the emission electric field for Examples 1 to 4 are shown in Table 10.

TABLE 10

| Diamond carbon film | Cs content (atomic %) | Emmission electric field (V/μm) |
|---|---|---|
| Example 1 | 0.22 | 6.4 |
| Example 2 | 0.58 | 4.5 |
| Example 3 | 1.12 | 3.5 |
| Example 4 | 1.48 | 4.05 |

(III) Electric Field Emission Characteristics

Figure 9:
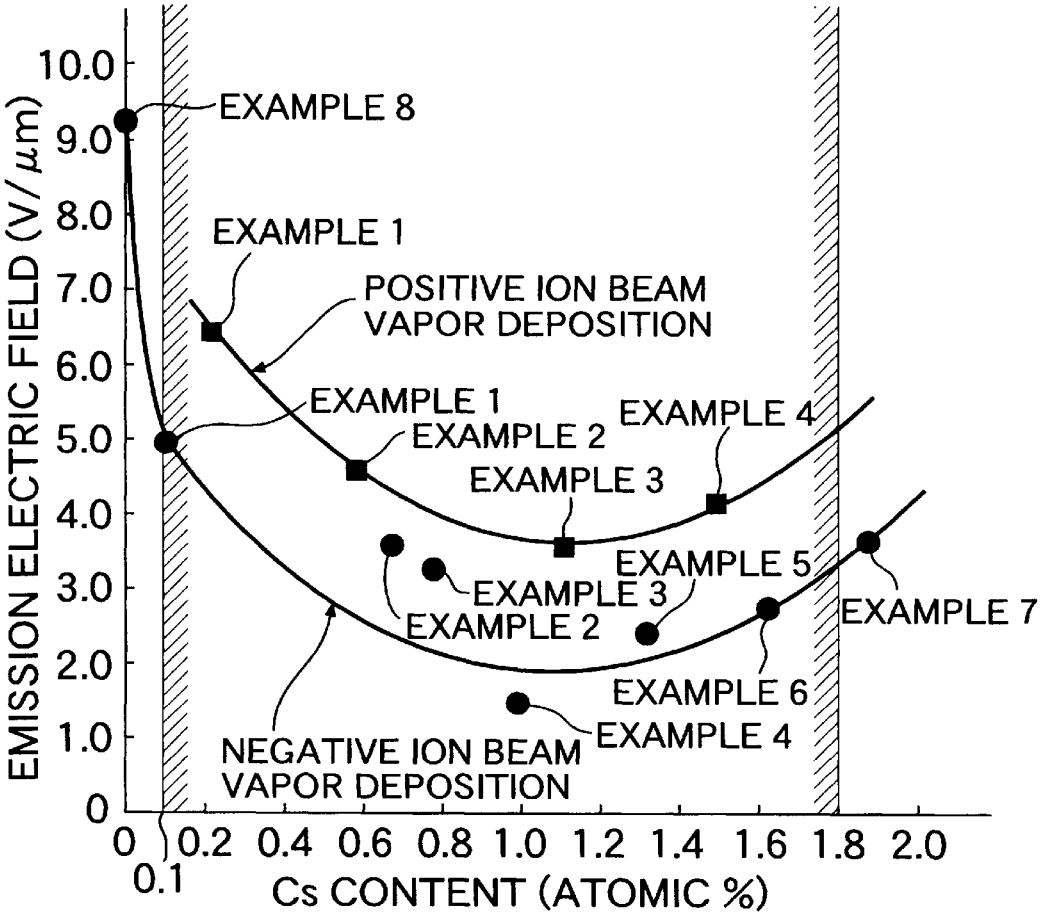
FIG. 9 is a graph showing the relationship between the Cs content and the emission electric field.

The relationship between the Cs content and the emission electric field based on Tables 8 and 10 for the diamond carbon films 3 is shown in FIG. 9. It can be understood from FIG. 9 that the emission electric field of the diamond carbon film 3 can be largely lowered by setting the Cs content to the range of from 0.1 to 1.8 atomic %. In Example 8, the Cs content is 0 atomic %, and the emission electric field is high. In Example 7, the Cs content is more than 1.8 atomic %, and cracks are formed. Furthermore, it is apparent that the field emission characteristics of the diamond carbon film 3 becomes higher in case of using the negative ion beam vapor deposition method than that of using the positive ion beam vapor deposition method.

The cold cathode elements of Embodiments I and II can be applied to a flat panel display, a voltage amplification element, a high frequency amplification element, a high precision close range radar, a magnetic sensor and a visual sensor.

The present invention may be embodied in other specific forms without departing from the spirit or essential characteristics thereof. The presently disclosed embodiments are therefore to be considered in all respects as illustrative and not restrictive, the scope of the invention being indicated by the appended claims, rather than the foregoing description, and all changes which come within the meaning and range of equivalency of the claims are, therefore, to be embraced therein.

What is claimed is:

1. A cold cathode element for emitting electrons upon application of an electric field, said element comprising a diamond carbon film having a half width Hw of a photoelectron spectrum of a $C_{1S}$ electron using an X-ray photoelectron spectroscopy, of 1.72 eV or more.

2. A cold cathode element as claimed in claim 1, wherein said diamond carbon film is formed by an ion beam vapor deposition method.

3. A cold cathode element as claimed in claim 1, wherein said diamond carbon film is formed by an ion beam vapor deposition method using a negative ion beam.

* * * * *